United States Patent [19]

Kelly et al.

[11] Patent Number: 4,802,316

[45] Date of Patent: Feb. 7, 1989

[54] EAVE TRUSS AND METHOD FOR SUPPORTING AND REINFORCING A CONCRETE OR MASONRY WALL AND METAL ROOF STRUCTURE

[75] Inventors: David L. Kelly, Sacramento; Jeffrey R. Needham, Modesto, both of Calif.

[73] Assignees: The Burke Company, Sacramento, Calif.; AMCA International Corp.

[21] Appl. No.: 78,853

[22] Filed: Jul. 28, 1987

[51] Int. Cl.[4] ..... E04B 7/02

[52] U.S. Cl. ..... 52/90; 52/636; 52/690; 52/695; 52/741

[58] Field of Search ..... 52/86, 82, 90, 92, 278, 52/483, 641, 643, 634, 636, 646, 648, 716, 729–732, 741, 695, 696, 690

[56] References Cited

U.S. PATENT DOCUMENTS

| | | | |
|---|---|---|---|
| 1,453,114 | 4/1923 | Rapp et al. | 52/695 X |
| 1,540,593 | 6/1925 | Birch | 52/690 |
| 1,762,112 | 6/1930 | White | 52/695 X |
| 1,839,178 | 12/1931 | Rebman | 52/693 X |
| 2,514,607 | 7/1950 | McLean | 52/693 X |
| 3,062,340 | 11/1962 | Hunnenbeck | 52/646 |
| 3,248,077 | 4/1966 | Charles | 211/182 X |
| 3,289,362 | 12/1966 | Whelan | 52/92 |
| 3,336,718 | 8/1967 | Cape | 52/650 |
| 3,479,780 | 11/1969 | Schwarz et al. | 52/169.7 |
| 3,492,765 | 2/1970 | Behlen | 52/18 |
| 3,845,595 | 11/1974 | Abrams | 52/93 |
| 3,890,755 | 6/1975 | Specht | 52/645 |
| 4,106,245 | 8/1978 | Lowe | 52/90 |
| 4,192,108 | 3/1980 | Lowe | 52/90 |
| 4,295,304 | 10/1981 | Kim | 52/90 |
| 4,301,621 | 11/1981 | Lowe | 52/90 |
| 4,569,501 | 2/1986 | McCracken | 249/209 |
| 4,594,823 | 6/1986 | Hague | 52/90 |
| 4,660,799 | 4/1987 | Butland | 248/676 |
| 4,706,436 | 11/1987 | Mabey et al. | 52/645 |
| 4,720,957 | 1/1988 | Madray | 52/732 |

FOREIGN PATENT DOCUMENTS

| | | | |
|---|---|---|---|
| 966272 | 4/1975 | Canada | 52/694 |
| 1455265 | 11/1976 | United Kingdom | 52/741 |

*Primary Examiner*—John E. Murtagh
*Assistant Examiner*—Andrew J. Rudy
*Attorney, Agent, or Firm*—Limbach, Limbach & Sutton

[57] ABSTRACT

The invention provides an eave truss for anchoring, supporting and reinforcing a metal roof and "tilt-up" or other prefabricated concrete or masonry walls in a building against the vertical load exerted by the roof itself, the lateral load exerted by wind and seismic forces, and load caused by thermal expansion and contraction of various attached heterogeneous building components. The eave truss is supported by the roof beams, and a single eave truss is attached to the roof, the ends of the roof beams, and the wall along the full length of each end of the building. The eave truss attachment to the wall is in shear only at the center portion of the truss; all other attachments to the walls from the eave truss are made through horizontally slotted holes in the eave truss to allow normal thermal expansion and contraction of the heterogeneous parts.

35 Claims, 1 Drawing Sheet

EAVE TRUSS AND METHOD FOR SUPPORTING AND REINFORCING A CONCRETE OR MASONRY WALL AND METAL ROOF STRUCTURE

TECHNICAL FIELD

The present invention relates generally to buildings constructed using prefabricated components and more specifically to means for anchoring, supporting and reinforcing prefabricated concrete or masonry walls and metal roof structures.

BACKGROUND OF THE INVENTION

Modern buildings are often constructed from "tilt-up" concrete walls which are cast at the work site or factory precast, and masonary walls. The walls in such buildings are unitially attached to each other at the top using roof beams, on which the roof purlins and other roof components are supported.

In the past such buildings were constructed using wind and/or bond beams across the roof beams adjacent to the walls at each end to reinforce the top of the walls against the lateral force of wind. Further, in geographical locations where seismic forces are encountered, the lateral seismic effect has to be taken into account in determining the size of such reinforcing beams. In addition, such beams are also used to anchor the wall to the roof structure, reinforcing the wall against the vertical load of the roof structure. Plywood panels may also be used to form a roof sub-diaphragm in combination with such structures to reinforce the roof from lateral forces to prevent twisting and buckling. However, because of the material costs and the lack of sidewall columns in some situations, the use of wind and/or bond beams is not always satisfactory.

Because the roof support beams and other roof structures are often constructed from steel or other metal materials having a different thermal coefficient of expansion from that of the concrete or masonary walls to which the roof is attached, the force exerted during thermal expansion or contraction at the points of attachment between the roof structure and the walls may adversely affect the structural integrity of the building, and, thus, also has to be taken into account and makes the attachment of such wind and/or bond beams problematical.

Thus, the need exists for a support system capable of attaching the roof to the walls of a building, reinforcing the walls against the lateral loads of wind and seismic forces and the vertical load of the roof structure, reinforcing the roof by acting as a diaphragm to prevent twisting and buckling when lateral forces act on the walls, and permitting thermal expansion and contraction of the heterogeneous wall and roof components without adversely affecting the integrity of the assembled building.

The present invention solves these problems by providing a truss which extends along each end of the building, which is attached to the wall, roof and roof beams, and which provides lower material costs, reinforcement of both walls and roof against vertical and horizontal loads even in situations where there is a lack of sidewall columns, and a means for allowing normal thermal expansion and contraction of the attached heterogeneous components.

SUMMARY OF THE INVENTION

In one embodiment, the present invention provides an eave truss constructed from an outer channel or beam and an inner channel or beam which are attached together, reinforced against each other and maintained in a spaced, parallel relationship to each other using cross and diagonal support members. The eave truss is supported and functions in a generally horizontal position, with the bottom of both the outer and inner channel attached to and supported by the roof beams and with the top of both the outer and inner channel attached to and anchoring the roof. The outer channel is also attached to and reinforces the top of the wall against both vertical and lateral loads. To avoid problems with thermal expansion and contraction of the heterogeneous components, only the attachment between the wall and the center of the outer channel of the eave truss is in shear; the remaining points of attachment between the wall and the eave truss are through slotted holes which will permit normal thermal expansion and contraction without damage or adverse effect to the structural integrity of the assembled building.

In another embodiment, the present invention provides an improved roof assembly for a building constructed from two generally parallel opposing roof beams attached one to each end of the building; a generally horizontal eave truss extending along and attachable to each end of the building and attached across the ends of the roof beams at the eaves at about a 90 degree angle to the roof beams; a plurality of roof purlins attached across the roof beams at about a 90 degree angle, parallel to and spaced away from each other and the eave trusses; and a metal roof attached to the eave trusses and the roof purlins.

In yet another embodiment, the invention provides an improved building in which a generally horizontal eave truss is attached along each end of the building to connect and reinforce the roof structure and the top of the walls of the building against wind, seismic and thermal loads and in which the attachment to the wall is in shear only at the center of the eave truss.

In yet another embodiment, the invention provides a method for reinforcing the top of a wall and a roof structure against wind, seismic and thermal loads by placing an eave truss along the each side of a building at the ends of the roof beams in a generally horizontal position, attaching the center portion of the eave truss to the center of the wall in shear, slidably attaching the end portions of the eave truss to the wall, and then attaching the eave truss to the roof beams and the roof.

BRIEF DESCRIPTION OF THE DRAWINGS

A better understanding of the invention and its advantages will be apparent from the detailed description taken in conjunction with the accompanying drawings in which.

DETAILED DESCRIPTION OF THE INVENTION

Figure 1:
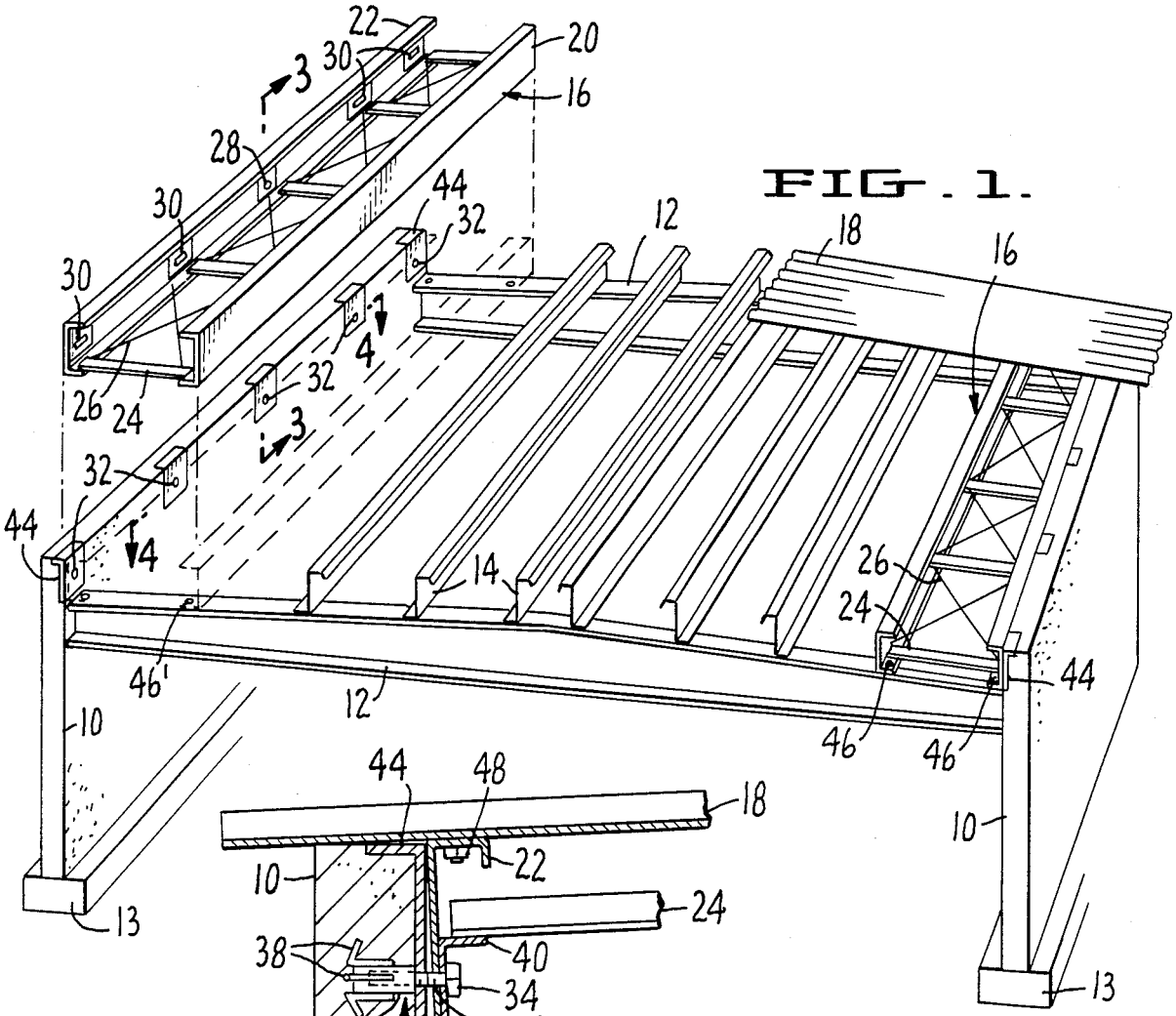
FIG. 1 is an exploded perspective view of a building showing the eave truss of the present invention in place against the wall at one side of the building and in a position to be placed against the wall of the opposing side of the building.
Figure 2:
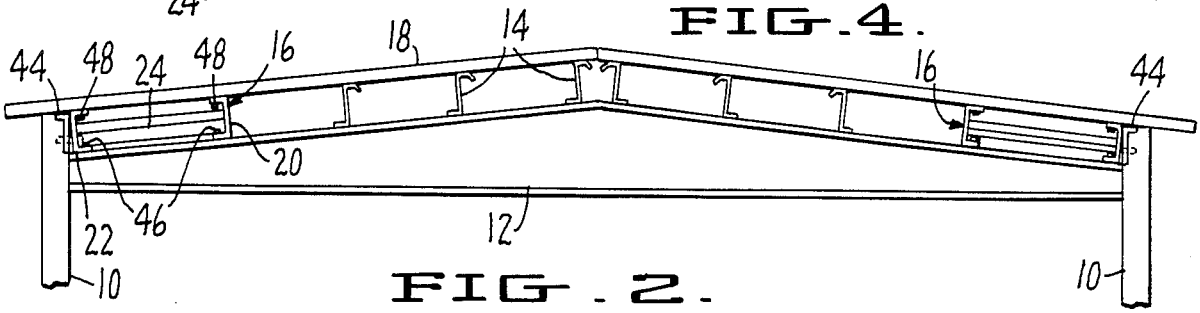
FIG. 2 is an end view of the building in FIG. 1, showing the relationship between the eave trusses, the roof beam, the roof, and the walls.

FIGS. 1 and 2 show two concrete or masonry walls 10 connected at each end by a roof beam 12 which may be constructed of steel or other suitable material. Such walls 10 may be precast and placed in an upright configuration on an appropriate foundation 13 at the work site, or may be cast or constructed on site, placed in an upright position on an appropriate foundation, and supported in the upright position by braces until the roof structure is substantially complete and anchors the walls 10 in an upright position. Purlins 14 of steel or other suitable material are attached to the roof beams 12 to support the vertical load of the roof 18 which may be constructed from corrugated sheet metal or other suitable material.

The eave truss 16 of the present invention comprises an outer channel 22 and an inner channel 20 which preferably have a squared "C" cross section and which are attached together, reinforced and held parallel to each other by cross support members 24 and diagonal support members 26. The cross support members 24 are attached to the inner surface of the outer channel 22 and the inner surface of the inner channel 20 at about a 90 degree angle, preferably by welding to a support member attachment plate 40, although attachment is possible by other means including welding support members 24 directly to the inner surfaces of the outer channel 22 and the inner channel 20. The support member attachment plate 40 may have an "L" shaped cross section or any other configuration which will aid in attaching the cross support members 24 at about a 90 degree angle relative to the inner surfaces of the inner channel 20 and the outer channel 22 and is preferably attached to the inner surfaces of the outer channel 22 and the inner channel 20 by welding. The diagonal support members 26 are attached to the inner surfaces of the outer channel 22 and the inner channel 20 at an angle of other than about 90 degrees and preferably are attached at one end at or near the intersection of a cross support member 24 and the inner surface of either channel and at the other end at or near the intersection of an adjacent cross support member 24 and the inner surface of the other channel. The diagonal support members 26 are preferably attached to the inner surfaces of the outer channel 22 and the inner channel 20 by welding to a support member attachment plate 40, although attachment is possible by other means including welding the diagonal support members 26 directly to the inner surfaces of the outer channel 22 and the inner channel 20.

The assembled eave truss 16 should be long enough to reinforce the entire wall to which it is attached. Preferably, thus, the eave truss 16 is about as long as the wall to which it will be attached and should be at least about 3 feet and no more than about 5 feet wide for most buildings having precast concrete walls and metal roof construction. This width is measured from any point on the outer surface of the outer channel 22 to a point on the outer surface of the inner channel 20 along a line perpendicular to both the outer channel 22 and the inner channel 20.

The assembled eave truss 16 is placed in a horizontal position on the roof beams 12 adjacent to the wall 10, as shown in the drawings, for attachment to the roof beams 12, the wall 10 and the roof 18. The wall 10 is factory precast or constructed at the worksite preferably with threaded bolt inserts 32 anchored within the wall material and located to cooperate with the circular shear bolt hole 28 drilled through the center of the outer channel 22 of the eave truss 16 and the horizontally slotted bolt holes 30 drilled through the outer channel 22 of the eave truss 16 on either side of the centered shear bolt hole 28. However, other fastening means such as bolts or studs anchored in the wall 10 may be used for attaching the eave truss 16 to the wall 10.

In the preferred embodiment, the support member attachment plate 40 will be attached to the inner surface of the outer channel 22 at the location of the shear bolt hole 28 and slotted bolt holes 30 and will be drilled through to provide a passage of identical dimension to that of the hole which is overlays to enable the passage of a bolt 34, stud or other fastener through each shear bolt hole 28 and slotted bolt hole 30 and the attached support member attachment plate 40 to enable the eave truss 16 to be attached to the wall 10. Although only one shear bolt hole 28 is shown in the drawings, it would be possible to use more than one shear bolt hole 28 at the center portion of the outer channel 22 of the eave truss 16 and still provide for thermal expansion and contraction since the eave truss 16 would be in shear in relation to the wall only at the center portion of the eave truss 16. In the preferred embodiment, the eave truss 16 is attached to the wall 10 by passing a bolt 34 through a single shear bolt hole 28 located at the approximate center point of the outer channel 22 of the eave truss 16 and through each slotted bolt hole 30 and into the bolt inserts 32 anchored in the wall 10. The eave truss 16 is then pulled into the wall 10 by tightening the bolts 34. The eave truss 16 is attached to the roof beam 12 and the roof 18 by attaching, for example, by bolting or using other fastening means 48, the bottoms of both the outer channel 22 and the inner channel 20 to the roof beams 12 and the tops of both are outer channel 22 and the inner channel 20 to the roof 18, by bolting through holes 46 and 46′ to anchor, support and reinforce both wall 10 and roof 18 against the lateral load of wind and seismic forces and the vertical load of the roof structure, to provide a diaphragm to reinforce the roof 18 against twisting or buckling forces imparted by lateral loading, and to permit thermal expansion and contraction of the dissimilar materials anchored together by the eave truss without endangering the integrity of the structure.

Figure 3:
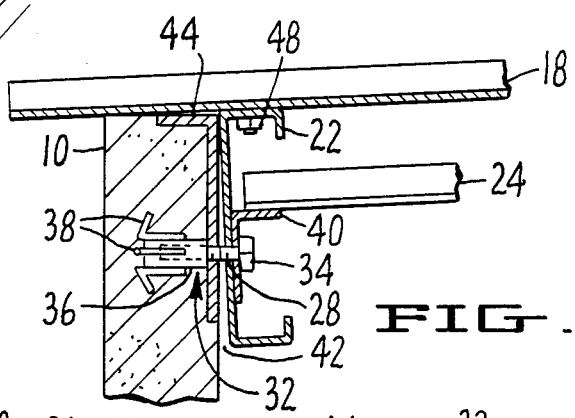
FIG. 3 is a cross-sectional view of the outer channel of the eave truss taken along line 3—3 of FIG. 1 showing the attachment of the eave truss to the wall.
Figure 4:
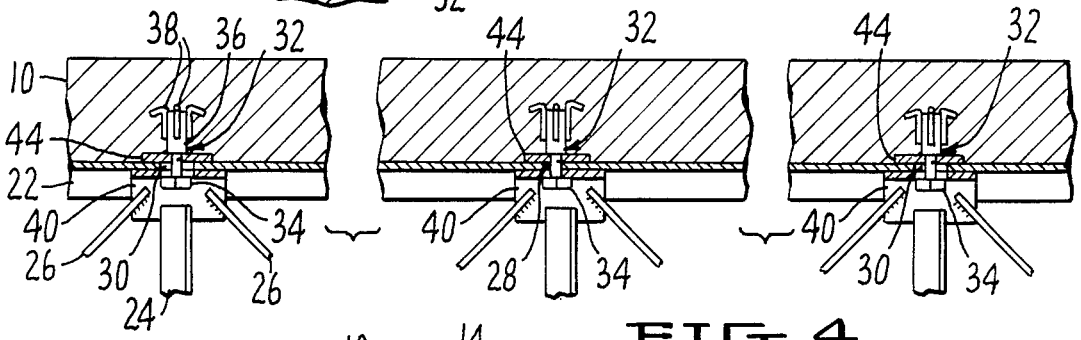
FIG. 4 is a fragmentary cross-sectional view of the outer channel, cross support members, and diagonal support members of the eave truss taken along line 4—4 of FIG. 1 showing the attachment of the eave truss to the wall through the shear bolt hole center and through the slotted bolt holes right, left.

FIGS. 3 and 4 show the preferred embodiment wherein the outer surface of the outer channel 22 of eave truss 16 is attached to wall 10 by passing bolts 34 through support member attachment plate 40, shear bolt hole 28 and slotted bolt holes 30 and into threaded bolt inserts 32 anchored within the wall 10. The eave truss 16 is pulled against wall 10 as bolts 34 are tightened. The shear bolt holes 28 and the slotted belt holes 30 in the preferred embodiment are drilled through both outer channel 22 and attached support member attachment plate 40, which is shown in FIG. 4 with cross support member 24 and diagonal support members 26 attached. The bolt inserts 32 are threaded to receive bolts 34 and can be anchored within wall 10 by using wire legs or other anchoring means 38 attached to bolt insert shaft 36. The bolt inserts 32 are accurately held in place in the concrete during curing preferably by using bolt inserts embedded in or attached to metal tabs 44 which can be nailed to the concrete forms before the concrete is poured or cast. The position of bolt inserts 32 in the concrete form and in the subsequently formed wall is determined by the location of the holes in eave truss 16 relative to its expected position on wall 10 in the finished building. In this regard, assembled eave truss 16 may be used as a template to determine the location of the bolt inserts 32 on the concrete form. When eave truss 16 is bolted to bolt inserts 32 which are preferably flush with the inside surface of wall 10, a gap 42 may result between the inside surface of wall 10 and the outer surface of outer channel 22 of eave truss 16. This gap 42 results because most roofs are sloped to shed water and snow. Gap 42 can be ignored for slopes of less than about 1:12. For slopes of about 1:12 or greater, shim plates may be used between the outer surface of outer channel 22 and the inner surface of wall 10 or the shape of the channels used to produce eave truss 16 may be modified to compensate for the gap, depending upon the actual slope of the roof.

The invention will be further understood from a consideration of the following example. It should be understood, however, that this example is merely an illustration and is not intended in any way to limit the scope of the claims.

EXAMPLE 1

For a concrete rectangular "tilt-up" building having four walls 26 feet in length, 22 feet high and 5.5 inches thick, two eave trusses 26 feet long by 5 feet wide would be constructed, each one requiring:

- 2 steel "C" Beams, 26 feet long and 8.5 inches deep with 2.75 inch flanges, each weighing approximately 130 pounds;
- 6 steel angle pieces for cross support members which are each 5 feet long with 3 inch by 3 inch legs;
- 10 Steel rod stock pieces for diagonal support members which are each 7 feet long and $\frac{3}{8}$ inches thick;
- 12 Steel "L" brackets for use as support member attachment plates, which are ach 3 inches long (back of the "L") by 3 inches long (foot of the "L"), 6 inches wide and 3/16 inches thick.

The tilt-up or masonry walls are constructed first. During construction of the walls, bolt inserts are embedded at or near the top of the concrete or masonry walls so that a first insert is located at the center top of the wall, a second and third insert is located about 2.5 feet on either side of the first insert and all other inserts are located at about 5 feet from the second and third insert, with all measurements made from center to center of the threaded bolt insert holes.

An eave truss of the present invention is constructed by locating the support member attachment plates on each "C" beam to correspond to the bolt inserts embedded in the prefabricated wall on either side of the center hole. These brackets are welded to the "C" beam. Slots or holes are then drilled through the "C" Beam which will form the outer channel by drilling through both the wall of the "C" beam and any support member attachment plates so as to cooperate with the bolt inserts or bolts embedded in the prefabricated wall. The slots are typically $\frac{7}{8}$ inches$\times$2 inches, and the hole at the center of the outer channel is $\frac{7}{8}$ inches in diameter. Because the length of the wall is not an even multiple of 5, the dimension from either end of the truss to the first interior attachment plate and slotted hole will be approximately 6 inches. The circular hole will be located at about the center of the outer channel to cooperate with the first bolt insert embedded at the top center of the wall. A first slotted hole and a second slotted hole will be located about 2.5 feet on either side of the circular hole to cooperate with the second bolt insert and third bolt insert embedded in the top of the wall. A third slotted hole will be located between the first slotted hole and the first end of the outer channel at about 5 feet from the first slotted hole. A fourth slotted hole will be located between the third slotted hole and the first end of the outer channel at about 5 feet from the third slotted hole and at about 6 inches from the first end of the outer channel. A fifth slotted hole will be located between the second slotted hole and the second end of the outer channel at about 5 feet from the second slotted hole. A sixth slotted hole will be located between the fifth slotted hole and the second end of the outer channel at about 5 feet from the fifth slotted hole and at about 6 inches from the second end of the outer channel. All such slotted holes are placed to cooperate with the bolt inserts located on the top of the wall on either side of the center insert, and are drilled through both the wall of the outer channel and through the welded support member attachment plates. In this example, the center hole is drilled through the wall of the outer channel only, its placement being between the location of the two center-most support member attachment plates.

The "C" beams are then placed opposite each other and the cross support members are welded to the support member attachment plates to hold the two "C" beams substantially parallel to each other. Diagonal support members are then attached by welding one end to a support member attachment plate and the other end to an oppossing, adjacent support member attachment plate.

The prefabricated walls are then placed in an upright position on a foundation and temporarily braced. Roof beams are attached. The eave trusses constructed above are placed across the roof beams at the ends of the building and bolted to the wall through the circular and slotted holes and the threaded inserts embedded in the wall. The eave trusses are then attached to the roof beams. The purlins are placed across and attached to the roof beams, and the roof is placed across and attached to the purlins and the eave truss to complete the construction of the roof assembly.

One skilled in the art will recognize at once that it would be possible to construct this invention from a variety of materials and that this invention could be used in the construction of many different kinds of buildings. While the preferred embodiment of the present invention has been described in detail and shown in the accompanying drawings, it will be evident that various modifications are possible without departing from the scope of the invention.

We claim:

1. An eave truss, for anchoring, supporting and reinforcing walls and a roof in a building resistant to seismic, wind or thermal loading, said building being constructed on a foundation and having at least two walls and a roof, with each wall having an inner side, an outer side and an upper portion and in which said roof is mounted on roof beams and purlins, said eave truss comprising:

an outer channel having two ends, a center portion, a top, a bottom, an inner surface, and an outer surface;

an inner channel having two ends, a top, a bottom, an inner surface, and an outer surface;

a first means for attaching said outer channel to said inner channel, for spacing said outer channel from said inner channel, for holding said outer channel and said inner channel substantially parallel to each other, and for supporting and reinforcing said outer channel and inner channel against each other to produce a rigid structure;

a second means for attaching the center portion of said outer channel of the eave truss against the inner side of the upper portion of the wall in shear; and, a third means for attaching the end portions of said outer channel of the eave truss against the inner side of the wall, said third means adapted to permit movement of the ends of the outer channel relative to the wall after the end portions of the outer channel have been attached to the wall.

2. The eave truss of claim 1 in which said first means comprises:

a plurality of cross support members attached at one end thereof to said inner surface of said outer channel and at the other end thereof to said inner surface of said inner channel to form about a 90 degree angle between each said cross support member and each said inner surface and to provide spacing to hold said outer channel and said inner channel substantially parallel to each other;

and, a plurality of diagonal support members attached at one end thereof to said inner surface of said outer channel and at the other end thereof to said inner surface of said inner channel to form an angle between said diagonal support members and said inner surfaces of other than abut 90 degrees.

3. The eave truss of claim 2 in which one end of each diagonal support members is attached at or near the intersection of a cross support member and the inner surface of either channel and the other end of each diagonal support member is attached at or near the intersection of an adjacent cross support member and the inner surface of the other channel.

4. The eave truss of claim 1 in which said outer channel has a "C" shaped cross section.

5. The eave truss of claim 1 in which said inner channel has a "C" shaped cross section.

6. The eave truss of claim 2 additionally comprising a plurality of support member attachment means on said inner surface of said outer channel and said inner surface of said inner channel for the attachment of said cross support members and said diagonal support members.

7. The eave truss of claim 6 in which each said support member attachment means is located on said outer channel at or near said second and said third means and on said inner channel at a point directly opposite.

8. The eave truss of claim 6 in which said support member attachment means is a bracket.

9. The eave truss of claim 8 in which said bracket is attached to said outer channel and said inner channel by welding.

10. The eave truss of claim 2 in which said cross support members and said diagonal support members are attached to said inner surfaces by welding.

11. The eave truss of claim 8 in which said cross support members and said diagonal support members are attached to said bracket by welding.

12. The eave truss of claim 1 in which the width of said eave truss is at least about 3 feet and no more than about 5 feet.

13. The eave truss of claim 1 in which said second means is at least one shear bolt hole located in the center portion of said outer channel and extending from said outer surface to said inner surface.

14. The eave truss of claim 1 in which said third means is a plurality of slotted holes located on both sides of said center portion of said outer channel between said center portion and the ends of said outer channel and extending from said outer surface to said inner surface.

15. The eave truss of claim 1 additionally comprising a plurality of bolting holes extending from the outer surface to the inner surface of the bottoms and tops of said outer channel and said inner channel for attaching said eave truss to said roof beams and said roof.

16. A roof assembly for a building constructed on a foundation and resistant to wind, seismic and thermal loading and having at least a first and a second wall, each said wall having an inner end an outer side and an upper and lower portion, said roof assembly comprising:

at least two roof beams, each said roof beam having a center portion, a first end and a second end, and attached to said walls such that said first end of a first roof beam is attached to the first wall at about a top right end of said first wall and said second end of said first roof beam is attached to the second wall at about a top right end of said second wall, and said first end of a second roof beam is attached to said first wall at about a top left end of said first wall, and said second end of said second roof beam is attached to said second wall at about a top left end of said second wall;

two generally horizontal eave trusses, comprising an outer channel and an inner channel spaced apart, held substantially parallel to each other, and reinforced against each other to form a rigid structure using cross support members and diagonal support members, said outer channel having a center and two ends, with one eave truss attached at one end thereof to at least said first end of said first roof beam and at the other end thereof to said first end of said second roof beam, and the other eave truss attached at one end thereof to at least said second end of said first roof beam and at the other end thereof to said second end of said second roof beam, said outer channels of said eave trusses being attached in shear at the center against the inner side of the upper portion of said walls, and being slidably attached at the ends by slidable attachment adapted to permit the movement of the ends of the outer channel relative to the wall after the outer channel is attached to the wall;

a plurality of roof purlins located between said two eave trusses, placed substantially parallel to said eave trusses and to each other, and attached at least at their ends to said first and said second roof beams; and a roof attached to said eave trusses and said roof purlins.

17. The roof assembly of claim 16 in which said shear attachment between said eave truss and said wall is made by passing a bolt through at least one bolt hole drilled through the center portion of said outer channel.

18. The roof assembly of claim 16 in which said slidable attachment is made by passing a bolt through a plurality of slotted holes drilled on both sides of said center portion between the edges of said outer channel and said center portion.

19. The roof assembly of claim 16 in which said roof is constructed from corrugated metal.

20. A building resistant to wind, seismic and thermal loading, said building comprising:

a foundation;

at least two walls having an upper portion and a lower portion, an inner side and an outer side, a right edge and a left edge;

at least two roof beams having a first end and a second end and attached to said walls such that the first end of a first roof beam is attached at about the upper right edge of a first wall, the second end of said first roof beam is attached at about the upper right edge of a second wall, the first end of a second roof beam is attached at about the upper left edge of said first wall and the second end of said second roof beam is attached at about the upper left edge of said second wall;

two generally horizontal eave trusses, each said eave truss comprising an outer channel and an inner channel spaced apart, held substantially parallel to each other and reinforced against each other to form a rigid structure using cross support members and diagonal support members, said outer channel having a center portion and two end portions, said eave trusses being attached to said roof beams such that a first eave truss is attached at one end thereof to at least said first end of said first roof beam and at the other end thereof to at least said first end of said second roof beam, and a second eave truss is attached at one end thereof to at least said second end of said first roof beam and at the other end thereof to at least said second end of said second roof beam, said outer channel of said first eave truss being placed against and attached to said inner side of the first wall at the upper portion such that the center portion of said outer channel will be attached to said first wall in shear, and such that the end portions will be attached by slidable attachments adapted to permit the movement of the ends of the outer channel relative to the wall after the outer channel is attached to the wall, said outer channel of said second eave truss being placed against and attached to said inner side of said second wall at the upper portion such that the center portion of the outer channel will be attached to the second wall in shear and such that the end portions will be attached by slidable attachments adapted to permit the movement of the ends of the outer channel relative to the wall after the outer channel is attached to the wall;

a plurality of roof purlins located between the first and second eave trusses and substantially parallel to said eave trusses and to each other, and attached at least at their ends to said roof beams; and, a roof attached to said eave trusses and said roof purlins.

21. The building of claim 20 in which said shear attachment is made by passing a bolt through at least one bolt hole drilled through the center portion of said outer channel.

22. The building of claim 20 in which said slidable attachment is made through a plurality of slotted holes drilled through said outer channel on both sides of said center portion between the center portion and the ends of the outer channel.

23. The building of claim 20 in which the roof is constructed from corrugated metal.

24. A method for anchoring a roof assembly and walls together so as to make them resistant to wind, seismic and thermal loading, said roof assembly comprising at least two roof beams attached at each end to a wall erected on a foundation and having an inner and an outer side and an upper portion, a plurality of roof purlins placed in a spaced relationship across and attached to the top of said roof beams at about a 90 degree angle thereto, and a roof laid over and attached to the top of said roof purlins, said method comprising the steps of:

placing on the roof beams at each end thereof in a generally horizontal position, an eave truss comprised of an outer channel and an inner channel spaced apart, held substantially parallel to each other and reinforced against each other to form a rigid structure using cross support members and diagonal support members, said outer channel having a central portion and two end portions, and said eave truss being placed such that the outer channel of said eave truss is placed against the inner side of the wall at the upper portion, said eave truss being long enough to substantially reinforce the entire wall;

attaching the central portion of the outer channel of the eave truss to the inner side of the wall in shear;

attaching the end portions of the outer channel to the inner side of the wall using slidable connections adapted to permit the movement of the ends of the outer channel relative to the wall after the outer channel is attached to the wall;

attaching the outer channel and the inner channel of the eave truss to the roof beams; and, attaching the outer channel and the inner channel of the eave truss to the roof.

25. The method of claim 24 in which the shear connection between the central portion of the outer channel and the wall is made by passing a bolt through at least one circular bolt hole drilled through the central portion of the outer channel.

26. The method of claim 25 in which the bolt is secured by tightening in a threaded insert placed in the wall.

27. The method of claim 24 in which the slidable connections are made by passing bolts through horizontally slotted holes drilled through the end portions of the outer channel.

28. The method of claim 27 in which the bolt is secured by tightening in a threaded insert placed in the wall.

29. A method for constructing a building resistant to wind, seismic and thermal loading, comprising the steps of:

constructing and placing in an upright position on a foundation, at least two walls facing each other, each said wall having an upper portion, a lower portion, an inner side and an outer side, a right edge and a left edge and containing a first means for attaching an eave truss to the upper portion of each said wall on the inner side;

connecting said walls together using at least two roof beams, each said roof beams having a first end and a second end, said roof beams attached to said walls such that the first end of a first roof beam is attached to the right edge of a first wall, the second end of the first roof beam is attached to the right edge of a second wall, the first end of a second roof beam is attached to the left edge of the first wall and the second end of the second roof beam is attached to the left edge of the second wall;

placing across the first ends of the roof beams a first eave truss, and placing across the second ends of the roof beams a second eave truss, each said eave truss comprising an outer channel and an inner channel spaced apart, held substantially parallel to each other and reinforced against each other to form a generally rigid structure using cross support and diagonal support members, said outer channel having a central portion and two end portions, said eave trusses being of sufficient length to substantially reinforce the entire wall against which it is placed, and said eave trusses being placed against the inner side of the walls along the upper portion in a generally horizontal position so as to cooperate with said first means;

attaching said central portion of each said outer channel to said first means using a shear connection;

attaching the end portions of each said outer channel to said first means using slidable connections adapted to permit the movement of the ends of the outer channel relative to the wall after the outer channel is attached to the wall;

attaching said outer and inner channels of said eave trusses to the roof beams;

placing a plurality of roof purlins between said eave trusses such that said roof purlins are substantially parallel to said eave trusses and to each other;

attaching said roof purlins to said roof beams;

placing a roof over said eave trusses and said roof purlins; and, attaching said roof to said outer and inner channels of said eave trusses and said roof purlins.

30. The method of claim 29 in which said first means comprises a threaded insert for receiving a bolt embedded in the wall at each point along the wall where the eave truss is to be attached to the wall.

31. The method of claim 29 in which the shear connection between the outer channel of the eave truss and the wall is made by passing a bolt through a circular bolt hole drilled through the center portion of the outer channel of the eave truss.

32. The method of claim 30 in which the shear connection is made by passing a bolt through a circular bolt hole drilled through the outer channel of the eave truss, said bolt hole having substantially the same diameter as the threaded portion of the bolt, and into a cooperating threaded insert at about the center of the wall, said connection being substantially complete when said bolt has been tightened by screwing into said insert.

33. The method of claim 29 in which said slidable connection is made by passing a bolt through horizontally slotted holes drilled through the end portions of said outer channel of said eave trusses.

34. The method of claim 30 in which said slidable connection is made by passing a bolt through horizontally slotted holes drilled through the end portions of said outer channel of said eave trusses and into cooperating threaded inserts, said connection being substantially completed when said bolts have been tightened by screwing into said insert.

35. The method of claim 29 in which said roof is made from corrugated metal panels.

* * * * *